United States Patent [19]

Labie et al.

[11] 3,988,868

[45] Nov. 2, 1976

[54] SUPPORT FOR FLOOR TO HOLLOW CORE TOWER

[75] Inventors: Allan S. Labie, New York; Irwin Paul Lew, Forest Hills; Charles H. Thornton; Abraham Gutman, Old Bethpage, all of N.Y.

[73] Assignee: International Environmental Dynamics, Inc., New York, N.Y.

[22] Filed: Mar. 4, 1975

[21] Appl. No.: 555,313

[52] U.S. Cl. ..... 52/236; 52/73; 52/254; 52/259; 52/745

[51] Int. Cl.[2] ..... E04H 1/04; E04B 1/35

[58] Field of Search ..... 52/234, 258, 236, 254, 52/73, 255, 126, 256, 226, 257, 227, 235, 378, 259, 379, 745, 747

[56] References Cited

UNITED STATES PATENTS

| | | | |
|---|---|---|---|
| 3,017,723 | 1/1962 | von Heidenstam | 52/236 |
| 3,028,707 | 4/1962 | Sagalovitch | 52/126 X |
| 3,179,374 | 4/1965 | Walli | 52/126 X |
| 3,199,259 | 8/1965 | Long | 52/126 X |
| 3,254,466 | 6/1966 | von Heidenstam | 52/236 X |
| 3,293,313 | 12/1966 | Entwistle | 52/236 X |
| 3,555,763 | 1/1971 | Bloxom | 52/745 |
| 3,594,965 | 7/1971 | Saether | 52/745 X |
| 3,708,933 | 1/1973 | Yang | 52/236 X |
| 3,760,542 | 9/1973 | Haeussler | 52/378 X |

FOREIGN PATENTS OR APPLICATIONS

| | | | |
|---|---|---|---|
| 694,157 | 9/1964 | Canada | 52/236 |
| 74,609 | 8/1952 | Denmark | 52/236 |
| 1,168,156 | 12/1958 | France | 52/126 |
| 1,409,923 | 5/1969 | Germany | 52/236 |
| 73,141 | 5/1970 | Germany | 52/745 |
| 2,035,426 | 8/1971 | Germany | 52/227 |
| 97,546 | 12/1960 | Norway | 52/259 |

*Primary Examiner*—Price C. Faw, Jr.
*Assistant Examiner*—Leslie Braun
*Attorney, Agent, or Firm*—Townsend and Townsend

[57] ABSTRACT

A concrete floor is constructed at least partially about a supporting hollow core tower. The hollow core tower, which preferably includes a rectangular section, closely conforms to the border of the floor at the elevational outside section where the floor is fastened. The floor at its edge, immediate the tower sides, is provided with beam defining folds preferably bent down at an angle in the range of 30° to 60° from the major plane of the floor. At least one beam at each tower and at least two non-linearly aligned beams at each floor are nested at the floor-tower interface, typically below the major supporting surface of the floor. The tower sidewall at the floor is transpierced and threaded to receive a tension support member angularly depending downwardly and outwardly from the inside of the tower to the outside of the tower. Likewise and in registry with apertures transpierced in the tower, the beam at the tower inside includes apertures extending angularly downward. Those apertures extend through the floor fold at the tower outside. When the floor is raised to its full supported height, bolts are threaded through tower sidewalls, horizontal beams and slab folds and fastened at opposite ends to receive tension. The resultant fastening provides a vertical support to the floor through and at the beam as well as a friction support of the floor to the tower sidewall.

15 Claims, 7 Drawing Figures

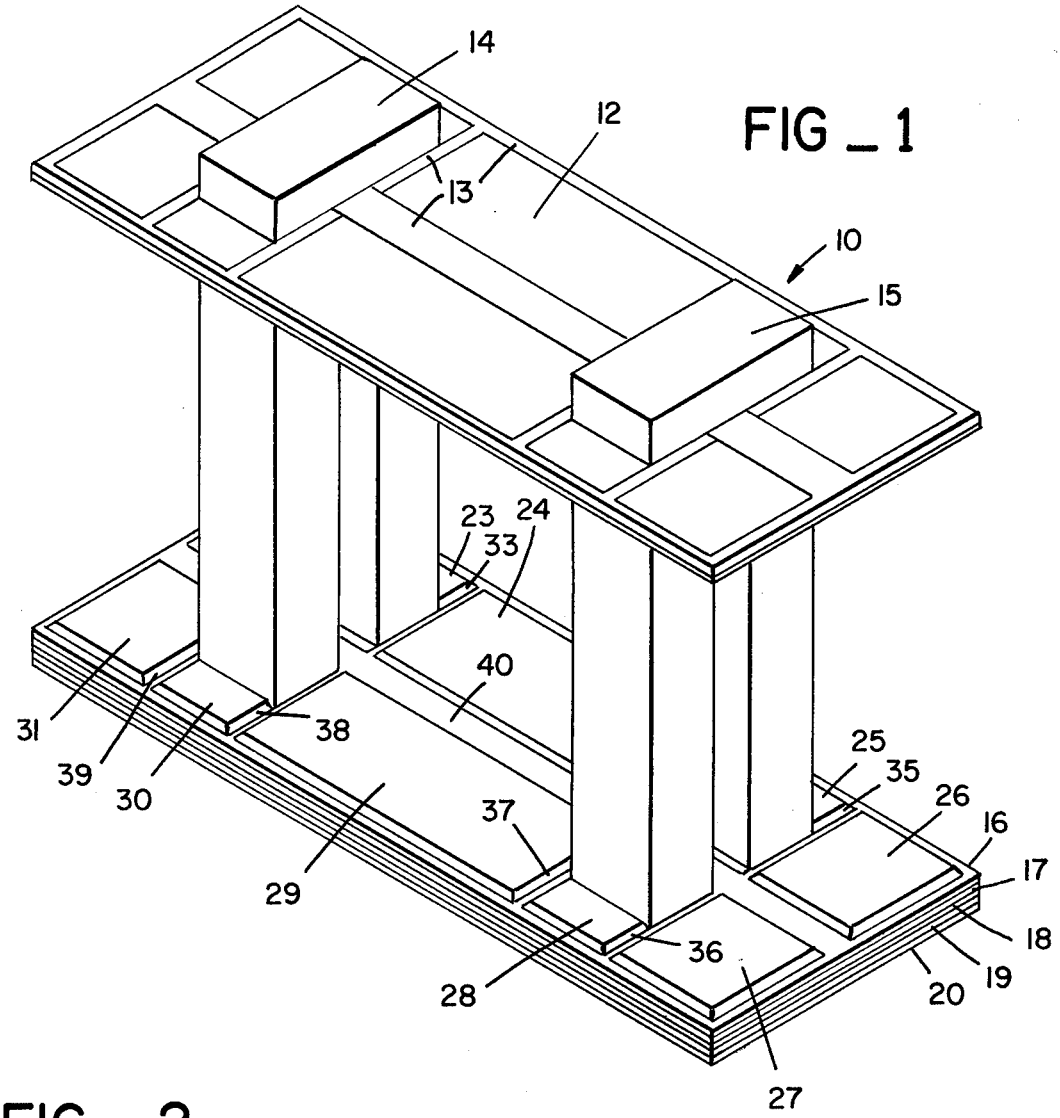
FIG _ 1
FIG _ 2
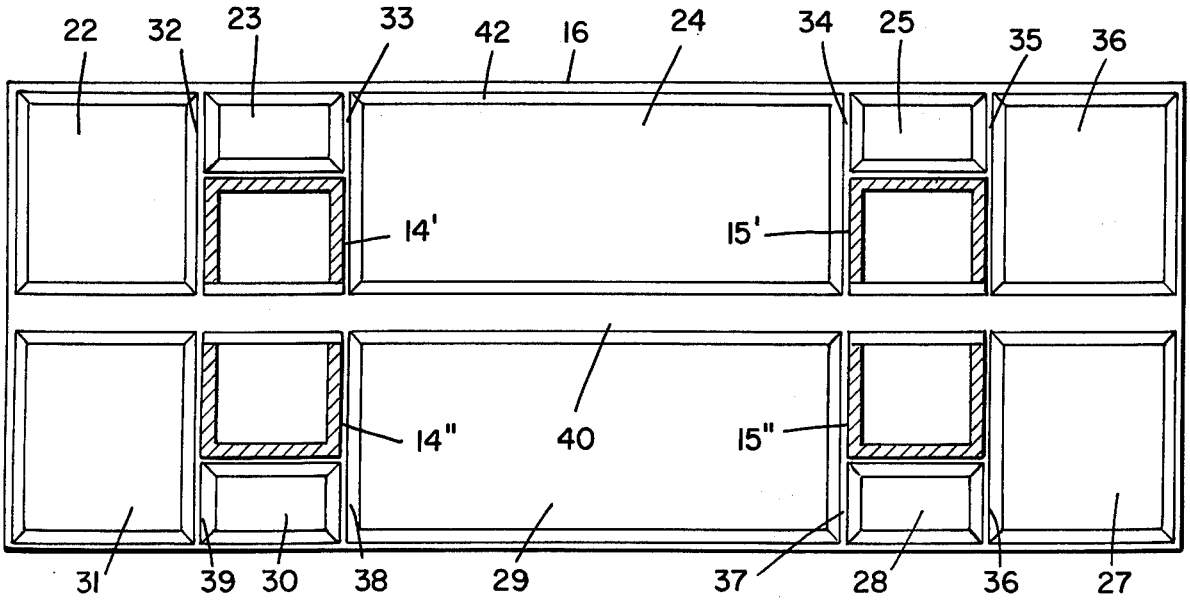

SUPPORT FOR FLOOR TO HOLLOW CORE TOWER

This invention relates to the support of a peripheral floor about a tower. More specifically, this invention relates to the support of such a floor in a building wherein floors are constructed at the base of a previously erected tower and sequentially hoisted, top floor first, bottom floor last, to their intended supported elevation to the sidewalls of a building.

SUMMARY OF THE PRIOR ART

Buildings having a central supporting tower with floors peripherally surrounding the tower are known. These buildings typically have the tower erected first and the floors constructed about the tower at the base of the tower second. When the floors are constructed, the floors are sequentially raised to their elevation and thereafter attached and supported from the tower.

The attachment and support of such ground constructed floors has been a matter of considerable difficulty in the prior art. For example, in the past depending supports extending from the top of the building for the support of all of the floors have been used. See for example Contevita U.S. Pat. 3,396,502, issued Aug. 13, 1968. Moreover, a problem exists not only in fabricating expensive straps for the support of such floors (see Erbil U.S. Pat. No. 3,686,816, issued Aug. 29, 1972), but additionally specialized connections to the top of the tower have been required. (See Patents supra)

Additionally, it is known to place bars in pockets of the previously erected tower for underlying support of hoisted floors. These bars are pulled out and placed as the floor is hoisted slightly above its intended elevation. The floor is lowered and supported on such bars. (See David E. Termohlen U.S. Patent Application Ser. No. 517,682, filed Oct. 24, 1974 entitled "Process and Apparatus for Supporting Hoisted Floors Peripherally of a Supporting Tower".

Unfortunately, such "pull bars" require complicated reinforcement of the tower sidewalls with resultant additional expense. Moreover, the bar constitutes an intrusion of not inconsiderable dimension into the occupancy space of the building between the floors and adjacent the tower. Finally, the bar constitutes an essentially point source of floor support and requires overlying steel beams to sufficiently distribute the load of the building.

SUMMARY OF THE INVENTION

A concrete floor is constructed at least partially about a supporting hollow core tower. The hollow core tower, which preferably includes a rectangular section, closely conforms to the border of the floor at the elevational outside section where the floor is fastened. The floor at its edge, immediate the tower sides, is provided with beam defining folds preferably bent down at an angle in the range of 30° to 60° from the major plane of the floor. At least one beam at each tower and at least two non-linearly aligned beams at each floor are nested at the floor-tower interface, typically below the major supporting surface of the floor. The tower sidewall at the floor is transpierced and threaded to receive a tension support member angularly depending downwardly and outwardly from the inside of the tower to the outside of the tower. Likewise and in registry with apertures transpierced in the tower, the beam at the tower inside includes apertures extending angularly downward. Those apertures extend through the floor fold at the tower outside. When the floor is raised to its full supported height, the bolts are threaded through tower sidewalls, horizontal beams and slab folds and fastened at opposite ends to receive tension. The resultant fastening provides a vertical support to the floor through and at the beam as well as a friction support of the floor to the tower sidewall.

OBJECTS AND ADVANTAGES OF THE INVENTION

An object of this invention is to disclose a simple tensive support for supporting a peripheral floor to a tower. According to this aspect of the invention, a floor designed for cantilever support has its edges placed immediately adjacent to the sidewalls of a tower. A tension support member extends angularly downward from the tower through the floor edge to provide floor support. The floor spans outwardly—typically by cantilever support—from the supported edges.

An advantage of this aspect of the invention is that the tensive support member provides support in at least three cooperating support components.

First, conventional vertical loading is resisted by the vertical component of tensive support.

Secondly, the horizontal loading of the tensive support urges the floor at its edge against the tower sidewall with considerable force. This urging of the floor edge against the tower sidewall at a typically concrete-to-concrete interface provides a static friction support component to the floor supplementing the vertical support component of the floor.

Thirdly, the spanning of the floor outwardly from the tower sidewalls contributes to the compression of the floor edge at the tower sidewall. Further compression of the concrete-to-concrete interface with a resultant additional component of support is provided.

An additional advantage of this aspect of the invention is that overhead support, such as straps and cables, are not required. Moreover, special connections to the tower top for floor support of such straps and cables are likewise not required.

A further advantage of this aspect of the invention is that appliances which pull out from the tower sidewalls need not be used. As a result, their complexities of tower reinforcement, intrusion into building occupancy space, and point support of floors do not complicate the present construction.

Yet another advantage of the support disclosed in this invention is that the resultant joinder of the floor to the supporting tower takes up no more building occupancy space than a conventional attachment of a cast-in-place floor to a cast-in-place tower. Thus, the economics of the ground construction of a floor can be realized without elaborate floor supporting joints.

A further object of this invention is to laterally reinforce a concrete floor with a stiffening beam at its joinder to a tower sidewall. According to this aspect of the invention, the floor is constructed with a folded plate extending angularly downward at the tower sidewall. A beam, either of the cast-in-place or precast variety, is placed to the floor at its edge adjacent the tower sidewall. The tension support member is threaded through the beam and through the floor to support both beam and floor at the intended elevation at the tower sidewall.

An advantage of this aspect of the invention is that the beam effectively thickens the plate of the floor at its point of attachment to the tower sidewall. Thus, the floor can receive at its edge abutting the tower sidewall great compressive force without danger of compressive collapse.

A further advantage of this invention is the beam, attached to the floor by the tension support members, forms a convenient point to laterally stiffen the floor along its length.

A further advantage of the folded plate at the floor edge abuttig the tower is that the folded plate can normally accommodate the tension support member. Thus, the plate is preferably folded normal to the tension support member to provide for efficient attachment to the floor.

Other objects, features and advantages of this invention will become more apparent after referring to the following specification and attached drawings in which:

BRIEF DESCRIPTION OF THE DRAWINGS

FIG. 1 is a perspective view of a partially constructed building having ground constructed, hoisted and elevated floors;

FIG. 2 is a plan view of one of the floor slabs of such a building prior to placement of the beam stiffeners therein;

DESCRIPTION OF THE PREFERRED EMBODIMENT

Figure 3:
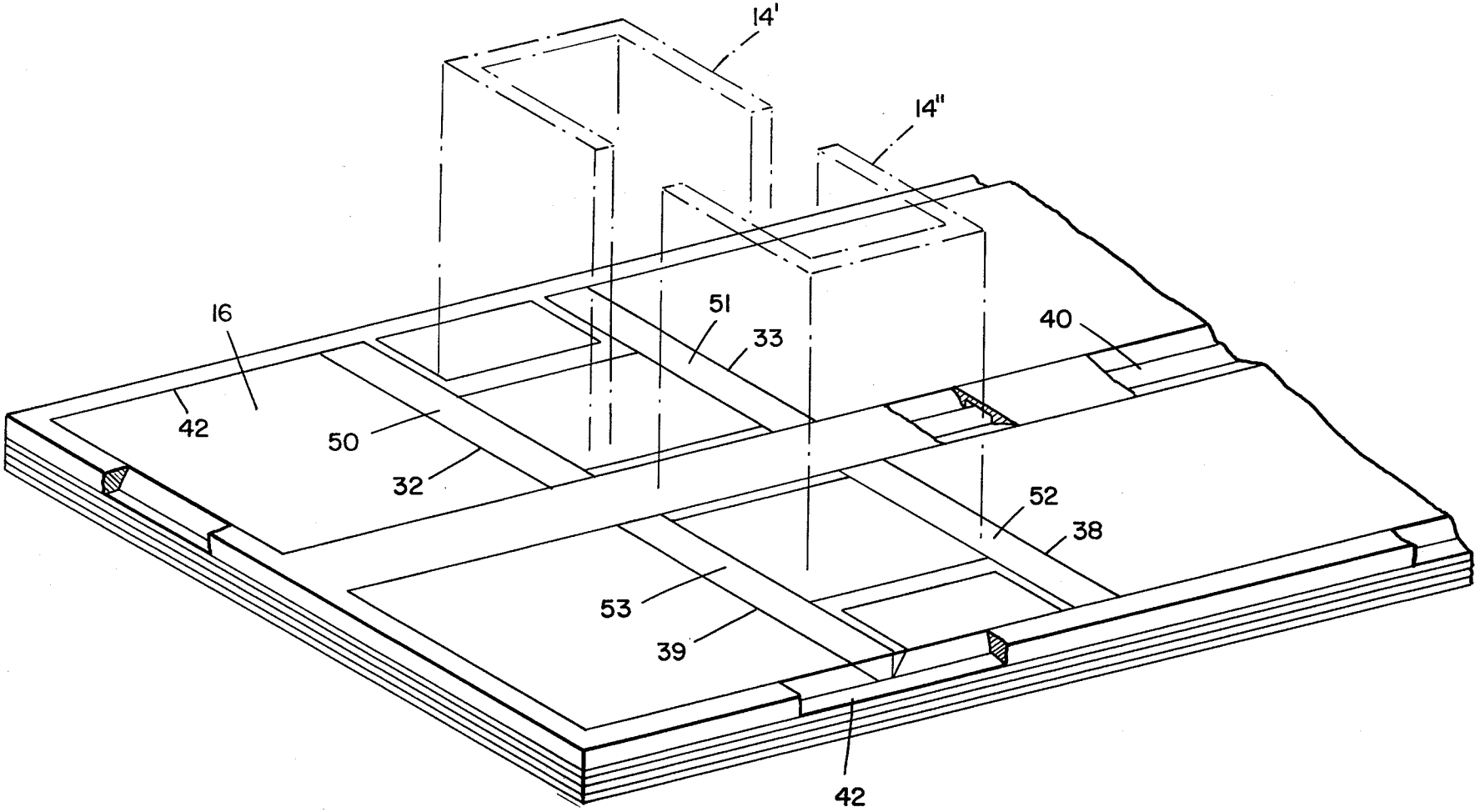
FIG. 3 is a perspective view of a portion of one of the floor slabs showing insertion of the beam stiffeners.

The present invention relates to a building such as 10 illustrated in FIG. 1 in which a pluarlity of floors are constructed at ground level and thereafter hoisted and fastened to core towers such as 14, 15. In the construction of building 10, the pair of core towers 14, 15 are first constructed at the building site. A pluarlity of floor slabs 12 and 16–20 are then poured in place one on top of the other at the base of the core towers. After all of the floor slabs have been poured and cured, the uppermost floor slab 12 is raised to its preselected elevated position and fastened to core towers 14, 15. After uppermost floor slab 12 has been fastened to the core towers, the next floor slab 16 is raised and fastened to the core towers, and the process is completed until the entire building has been constructed. It should be by now understood that the present invention relates to the manner in which the various floor slabs are attached to the core towers.

As depicted in FIG. 1, uppermost floor slab 12 has been raised to its preselected elevated position and has been fastened to core towers 14, 15. As discussed in more detail hereinafter, floor slab 12 has a folded plate construction including a plurality of beam stiffeners such as 13 inserted in the folds. The remainder of the floors 16–20 depicted in FIG. 1 are located at the base of the core towers and stacked one on top of another in a nested configuration prior to insertion of the beam stiffeners therein. Each floor 16–20 is subsequently provided with its beam stiffeners and raised to its preselected elevated position and fastened to core towers 14, 15.

As is evident from viewing FIGS. 1 and 2 in combination, each floor slab such as 16 has a folded plate construction which comprises a plurality of major planar portions 22–31 separated by a plurality of transverse folds 32–39 and a central fold 40. Lower slab 16 surrounds the pair of opposing C-shaped sections 14′, 14″ and 15′, 15″ of the core towers. As seen in FIG. 2, each core tower 14, 15 has opposing slots formed therein so that lower slab 16 bridges the towers through the slots, and central fold 40 traverses the entire floor slab including the portions bridging the core towers. The portion of the floor slab bridging the core tower provides a lobby floor, and divides the hollow interior of the tower into two shafts which can be used for elevators, fire stairs and the like. The entire border 42 of floor slab 16 is depressed as illustrated to the level of the lower portions of the folds.

Each fold 32–40 and the depressed border 42 of each floor slab provides a beam path. In the preferred embodiment of the present invention, such beam paths are filled with concrete beam stiffeners as illustrated in FIG. 3, which depicts floor slab 16 after the beam stiffeners are in place. In the placement of such beam stiffeners, precast reinforced concrete beams 50–53 are first inserted in the transverse folds such as 32, 33, 38, 39. Precast beams 50–53 occupy the major portion of folds 32, 33, 38, 39 except at the outer extremities of these folds. Reinforced concrete is then poured in place in the remaining folds and depressed areas in the floor slab, including the unfilled portions of the folds in which the precast beams have been placed. After the poured in place concrete is sufficiently cured to accept tension stresses in the reinforcing rods, the floor slab can be hoisted into place and fastened to the core towers as illustrated by floor slab 12 in FIG. 1.

Figure 4:
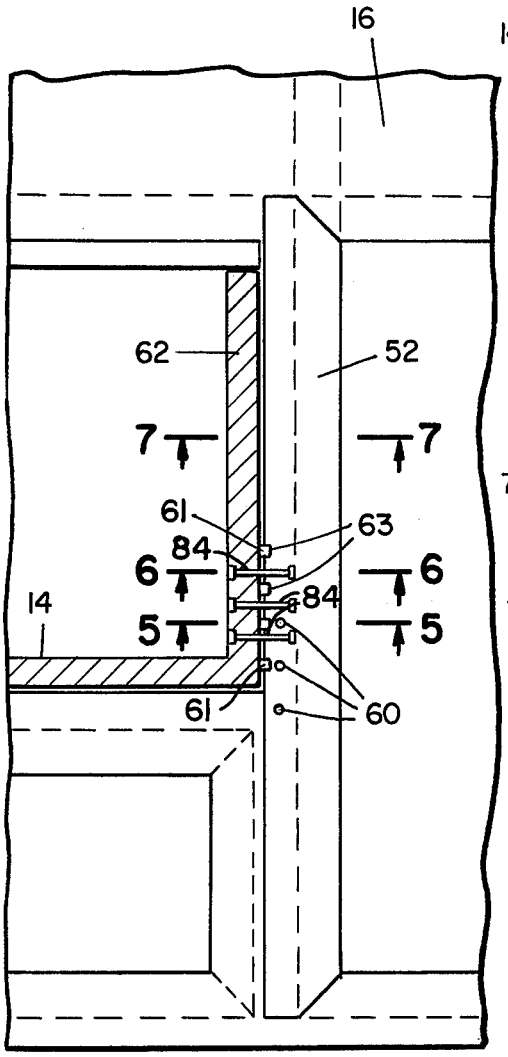
FIG. 4 is a fragmentary plan view of an elevated floor slab illustrating the fastening of the floor slab to a building tower.
Figure 5:
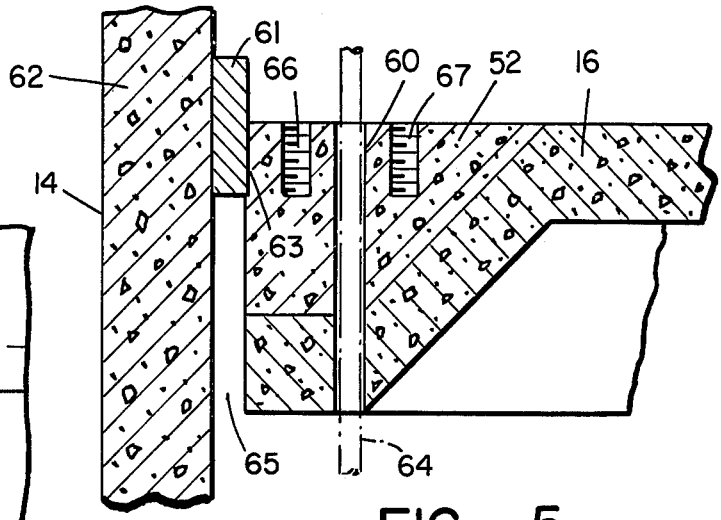
FIG. 5 is a cross sectional view taken along lines 5—5 of FIG. 4 at the location of one of the lifting rods.

A plurality of small apertures 60 are formed in each floor slab such as 16 adjacent each of the parallel sidewalls such as 62 of the core towers 14, 16, (See FIG. 4). A jacking pipe, illustrated in phantom at 64, projects upwardly through each of the apertures 60 in floor slab 16, as illustrated in FIG. 5. A pair of threaded apertures 66, 67 are provided in the upper surface of precast beam 52 and are engaged by the jacking device which lifts the floor slab to its preselected elevated position. Such jacking devices are known in the art and are not described in detail herein. Once floor slab 16 has reached its preselected elevated position, shims such as 61 are placed in shim pockets 63 to provide a space 65 between the floor slab and tower sidewall 62.

After floor slab 16 has reached its preselected elevated position, it is attached to the core tower by tension bolts 84. These bolts will be described in more detail hereinafter.

In order to understand the attachment of a floor, it should be appreciated that each floor has eight precast beams fastened to the floor. Referring to FIG. 3, one tower with precast beams 50–53 is shown. The other tower has four similar beams.

Each of the beams has a series of three tension bolts 84 attaching the beam to the tower. These tension bolts are located medially of each beam. Thus, each tower includes twelve tension bolts 84 fastening the floor to the tower. A total of 24 tension bolts fastens each floor to both towers.

Having understood that 24 bolts fasten each floor to a tower, it now remains to discuss the configuration of one bolt. It then will be understood by the reader that the remaining 23 bolts of each floor are substantially identical. Such a typical bolt detail is shown in FIG. 6.

Figure 6:
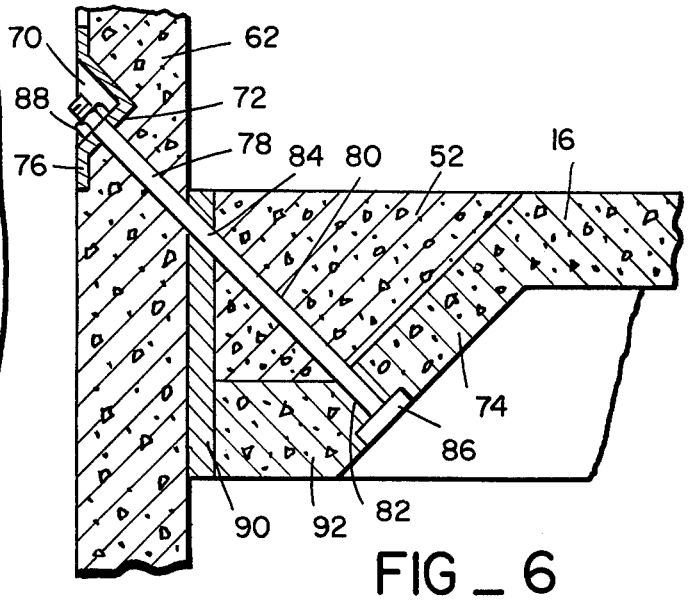
FIG. 6 is a cross sectional view taken along lines 6—6 of FIG. 4 at one of the fastening tension rods.

Regarding the typical detail of FIG. 6, a cylindrical indentation 70 is formed in the inside sidewall 62 of one of the core towers. The cylindrical indentation 70 terminates at a circular bottom 72. It will be observed that circular bottom 72 is parallel to the floor slab 16 at downwardly folded portion 74.

Cylindrical indentation 70 has a specialized metal fitting lining the indentation. As shown in FIG. 6, fitting 76 conforms to the inside core wall 62 of the tower. As will hereinafter become more apparent, this fitting receives the loading provided by a nut 88 in tensioning bolt 84. This loading is then distributed through the sidewall 62 to load the wall of the concrete tower.

In order to receive bolt 84 an aperture 78 is provided through the metal place 76 and core tower sidewall 62. This aperture extends downwardly and angularly. A corresponding aperture 80 is formed through each precast beam at the point where it is transpierced by bolt 84. Finally, an aperture 82 is formed in the downwardly folded portion 74 of the floor slab 16. It will be appreciated that apertures 78, 80 and 82 are normal to the plane of the folded portion 74 of the floor slab.

As each floor is raised, the respective apertures 78, 80 and 82 are brought into registry. A tension bolt 84 is inserted therethrough. The tension bolt projects downwardly and outwardly through the sidewall 62, precast beam 52 and folded portion 74 of the floor slab 16. The lower end of the tension member 84 is affixed a metal plate 86 embedded in the folded portion 74 of the floor slab 16. The opposite and upper member of the tension member 84 extends through the inside of the core tower wall 62. This end is threaded and engaged with a nut 88. Thus, tension member 84 provides tension between the floor slab 16 and the sidewall 62 of the core tower 14 to suspend the floor slab from the tower.

When the floor slab 16 is initially hoisted in place, a series of steel shims, typically four such shims as shown in FIG. 4, are inserted between the tower on one side and the floor edge on the opposite side. These steel shims allow the floor to be initially fastened to the tower sidewall and are illustrated in the detail of FIG. 5.

Once, however, the floor has been fastened to the tower sidewall, grout 90 can be pumped into the spatial interval between the tower sidewall 62 and the edge of the floor slab 16. Once this grout has cured, together with the shims, it forms the interface of the connection to the tower.

Having set forth the mechanical connection of the tower and floor, the unique support provided by the connection of this invention can be set forth..

It will be realized that bolt 84 and its supporting force on the floor 16 can be resolved into two components. One component of support is a vertical component. This component prevents floor 16 in the precast beam 52 from falling downwardly along the tower sidewalls.

An additional component of support is provided by the compression of the floor edge through the grout 90, shim 61 interface to the tower sidewall 62. This component of support is caused by the floor pressing inwardly towards the tower sidewall because of the tension exerted in bolt 84.

It should be noted that the grout 90 here provides a substantial friction force. The static coefficient of a concrete to concrete interface is relatively large. Because of the horizontal component of force transmitted from tension member 84 toward the core tower wall 62, a strong upwardly directed friction force will result. This upwardly directed friction force will be on the floor and will contribute substantially to the floor support at the tower sides.

In addition to the frictional force resulting from the horizontal component of force induced by tension member 84, the spanning of floor slab 16 as it extends outward from the core tower will result in a force imposed on tower sidewall 62 by the lower flange 92 of floor slab 16. This force will be resisted by tower sidewall 62 in terms of an equal and opposite force exerted outwardly on flange 92. Thus, the frictional force between tower sidewall 62 and floor slab 16 due to tension member 84 will be increased by the force caused by the bending of the floor slab to further maintain the floor slab in its elevated position.

Figure 7:
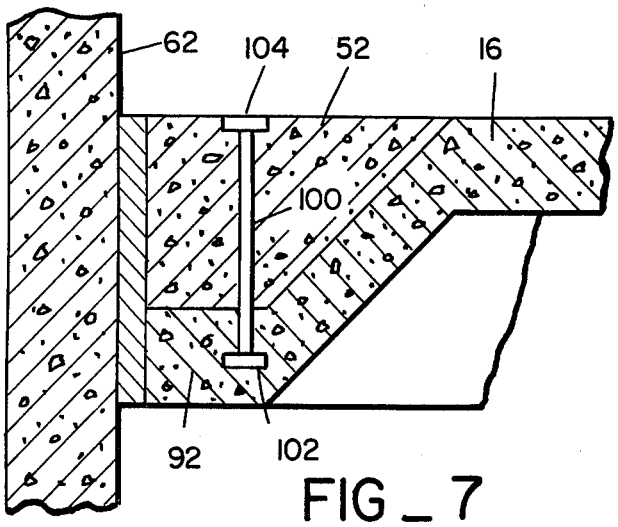
FIG. 7 is a cross sectional view taken along lines 7—7 of FIG. 1 at the location of one of the rods attaching the precast beam stiffener to the remainder of the floorer. In fact, slab.

As illustrated in FIG. 7, precast concrete beam 52 is fastened to floor slab 16 by means of a plurality of tension bolts such as 100. Each tension bolt 100 has one end connected to a plate 102 embedded in the lower flange 92 of floor slab 16, and an opposite end attached to a plate 104 on the upper surface of reinforced concrete beam 52. Such rods 100 maintain the precast beam fastened to floor slab 16 as the floor slab is being elevated into position, and also while the floor slab is maintained in position by tension members 84 and the friction between the floor slab and the core tower.

In operation, one or more core towers such as 14, 15 are constructed, and a plurality of floor slabs of folded plate construction are constructed at the base of the towers. Beam stiffeners are placed in the folds in the uppermost floor slab and it is elevated into position by jacks passing through apertures in the floor slab. When the floor slab has been raised to its preselected elevated position, tension members 84 are inserted downwardly and outwardly through registering apertures in the core tower sidewalls, the precast beam stiffeners and folded portions of the floor slab. One end of the tension member is attached to the floor slab and the other end is attached to the tower sidewall to hold the floor slab in its elevated position. The horizontal component force induced in the floor slab by the tension member compresses the floor slab against the tower sidewalls, and this compression is increased by the bending moment exerted on the tower sidewall by the floor slab. Such compression results in a frictional force which aids the tension member in maintaining the floor slab in its elevated position.

Tension members such as 84 holding the floor slab in its elevated position are inserted through the parallel sidewalls forming opposite sides of the core tower on each side of the slots formed in the core tower. The core tower is thus rigidly fixed to the floor slab on each side of the slots formed therein to prevent deflection in the sidewalls of the core tower. As a result, the structural integrity of the core tower itself will be enhanced by the attachment of the floor slabs thereto. As each floor slab is attached to the core tower, the tower will be stiffened along its length and when all of the floor slabs have been fastened in place, the entire length of the core tower will be strengthened and stiffened.

While a preferred embodiment of the present invention has been illustrated in detail, it is apparent that modifications and adaptations of that embodiment will occur to those skilled in the art. However, it is to be expressly understood that such modifications and adaptations are within the spirit and scope of the present invention as set forth in the following claims.

What is claimed is:

1. A concrete building construction including a central supporting tower and a plurality of floors peripherally supported from and about said tower, said building comprising: a tower having an interior extending from a foundation at a lower end at least to the height of said supported floors at its upper end; said tower including at least one extending from said foundation to the level of said supported floors, a floor having a major supporting surface constructed to abut said tower having an edge defining a continuous vertical interface with said vertical sidewall of said tower, said floor reinforced to span outwardly from a support at said edge from said tower; and, tension support means having upper and lower ends said edge, each said tension support means attached to the interior of said tower at said upper end and to said floor at said lower end and extending angularly downward from said tower to said floor proximate one respective edge to provide a first vertical support component to maintain said floor at its supported elevation to said tower and a second horizontal support component to urge said edge of said floor laterally against said tower sidewall to produce compression at the continuous vertical interface of said edge to said tower to produce a static coefficient of friction at said vertical support component for said floor.

2. The invention of claim 1 and wherein said tower includes two spaced apart, substantially parallel sidewalls, each floor including at least two spaced apart, substantially parallel edges and wherein said floor is constructed peripherally about said tower.

3. The invention of claim 1 and wherein said tower has a hollow core.

4. The invention of claim 1 and including a plate angularly folded downwardly from the major supporting surface of said floor at said edge; and wherein said tension support means extends normally through said folded plate at each edge.

5. The invention of claim 1 and including at least one beam attached to said floor at each said edge for supporting and stiffening said floor; each beam as attached having said tension support member pass there through between said tower and said floor.

6. A concrete building construction including a central supporting tower and a plurality of floors peripherally supported from and about said tower, said building comprising: at least two towers having an interior each tower extending from a foundation at a lower end at least to the height of said supported floors at its upper end; each tower including at least one substantially vertical sidewall extending from said foundation to the level of said supported floors; a floor having a major supporting surface constructed peripherally about said towers having a first edge defining a first continuous vertical interface with said vertical sidewall of one tower and a second edge defining a second continuous vertical interface with said vertical sidewall of said other tower, and reinforced to span outwardly from a support at said edge about said towers; and, tension support means having upper and lower ends for each said edge, said tension support means attached to the interior of said towers respectively at said upper end and to said floor at said lower end and extending angularly downward from said towers to said floor to provide a first vertical support component to maintain said floor at its supported elevation to said tower and a second horizontal support component to urge said edge of said floor laterally against said tower sidewall to produce compression at the continuous vertical interfaces of said edges of said towers to produce a static coefficient of friction at said vertical interface to provide a vertical support component to said floor.

7. The invention of claim 6 and wherein said towers have a hollow core.

8. The invention of claim 6 and including a plate angularly folded downwardly from the major supporting surface of said floor at each said edge; and wherein said tension support means extends normally through said folded plate at each said edge.

9. The invention of claim 6 and including at least one beam attached to said floor at each said edge for supporting and stiffening said floor; each beam as attached having said tension support member pass there through between said tower and said floor.

10. A concrete building construction including a central supporting tower and a plurality of floors peripherally supported from and about said tower, said building comprising: a hollow core tower extending from a foundation at a lower end at least to the height of said supported floors at its upper end; said tower including at least two spaced apart, substantially vertical sidewalls extending from said foundation to the level of said supported floors; a floor constructed peripherally about said tower having a first continuous, vertical edge immediately conjoined to one of said vertical sidewalls and a second continuous vertical edge immediately conjoined to the other of said vertical sidewalls of said tower; and, tension support means having upper and lower ends for each edge attached to the interior of said tower at said upper end and to said floor at said lower end and extending angularly downward from said core to said floor to provide a first support component to maintain said floor at its supported elevation to said tower and a second support component to urge said edge of said floor laterally against said tower sidewall to produce compression at the continuous vertical interfaces of said edges to said tower to produce a static coefficient of friction at said interface to provide a component of vertical support to said floor.

11. The invention of claim 10 wherein said tower comprises a pair of confronting C-shaped sections each having two spaced apart, substantially parallel sidewalls, said floor having edges adjacent each of said spaced apart sidewalls.

12. The invention of claim 10 and additionally comprising grout interposed between each said edge of the floor and the associated sidewall of the tower, at least a portion of the second support component being transmitted through said grout to the tower sidewall to provide an upwardly directed friction force to partially support the floor.

13. A concrete building construction including a central supporting tower and a plurality of floors peripherally supported from and about said tower, said building comprising: a hollow core tower extending from a foundation at a lower end at least to the height of said supported floors at its upper end; said tower including at least two spaced apart, substantially vertical sidewalls extending from said foundation to the level of said supported floors; a floor constructed peripherally about said tower having a first edge defining a first continuous vertical interface with one of said vertical sidewalls and a second edge defining a second continuous vertical interface with the other of said vertical sidewalls of said tower; at least one beam attached to said floor at each said edge for supporting and stiffening said floor; tension support means having upper and lower ends for each edge at each beam attached to the interior of said tower at said upper end and to said floor at said lower end and extending angularly downward from said core to said floor through said beam to provide a first support component to maintain said floor at its supported elevation to said tower and a second support component to urge said edge of said floor laterally against said tower sidewall; and grout material interposed between each said edge of the floor and the tower sidewalls so that at least a portion of said second support component is transmitted through the grout to said sidewalls to provide an upwardly directed friction force to provide vertical support to the floor.

14. The invention of claim 13 and additionally comprising a plurality of shims interposed between each said edge of the floor and the tower sidewalls so that a portion of said second support component is transmitted through the shims to the tower sidewalls.

15. The invention of claim 13 wherein the tension support means comprises a plurality of angularly disposed support bolts attached to the interior of the tower at the upper end and to the floor at the lower end, and wherein the shims are located on both side of each support bolt.

* * * * *